United States Patent [19]

Mulligan

[11] 4,072,230

[45] Feb. 7, 1978

[54] ASSEMBLY FOR SUPPORTING DELICATE EQUIPMENT DURING SHIPPING

[75] Inventor: Vincent R. Mulligan, Syracuse, N.Y.

[73] Assignee: L. K. Van Keuren Company, Inc., Marcellus, N.Y.

[21] Appl. No.: 678,614

[22] Filed: Apr. 20, 1976

[51] Int. Cl.[2] ..... B65D 85/48; A47G 19/08

[52] U.S. Cl. ..... 206/334; 211/41; 206/454; 206/565

[58] Field of Search ..... 211/41; 206/334, 449–456, 206/73, 565

[56] References Cited

U.S. PATENT DOCUMENTS

| | | | |
|---|---|---|---|
| 970,491 | 9/1910 | Grandperrin | 211/41 |
| 2,618,905 | 11/1952 | Dicks et al. | 211/41 |

FOREIGN PATENT DOCUMENTS

| | | | |
|---|---|---|---|
| 1,251,835 | 2/1967 | Germany | 211/41 |
| 359,857 | 3/1962 | Switzerland | 211/41 |

*Primary Examiner*—William Price
*Assistant Examiner*—Douglas B. Farrow
*Attorney, Agent, or Firm*—Bruns & Jenney

[57] ABSTRACT

An assembly for protectively supporting a frame or panel containing delicate electronic equipment such as communication equipment while it is being shipped from one location to another. The electronic units with which the invention is concerned are usually large, complicated and costly. The support assembly, which is adapted to be contained in an outer carton, provides adjustable means for gripping the electronic unit so that the delicate equipment therein will not be damaged by vibration or impact caused by travel.

7 Claims, 4 Drawing Figures

ASSEMBLY FOR SUPPORTING DELICATE EQUIPMENT DURING SHIPPING

BACKGROUND OF THE INVENTION

This invention relates generally to the field of packaging, and has particular reference to a novel support assembly for positively gripping relatively large units of electronic equipment so as to minimize damage thereto during transit.

Heretofore, in shipping large units of electronic equipment such as communication equipment it has been the practice to provide each unit with a special protective, non-adjustable wood support assembly. For reasons of economy, the wood is usually green and uncured so that it is subject to warping and swelling caused by climate changes in travelling from one area to another. Because allowance must be made for possible warping and swelling of the wood, the fixed components of the support assemblies cannot be made to engage the electronic unit too closely. As a result, the unit can move within the assembly due to travel vibration and this movement frequently results in damage to the equipment.

SUMMARY OF THE INVENTION

The support assembly of the present invention is essentially comprised of a normally horizontal base assembly and a pair of upstanding end braces that are rigidly secured to the base assembly at opposite ends thereof. The frame or panel having the electronic equipment rests on the base assembly between the end braces. Each end brace includes a pair of normally vertical clamping members that are movable towards or away from one another for clamping engagement with an end of the equipment frame. Each end brace also includes a normally horizontal clamping member that is movable towards or away from the base assembly for clamping engagement with another part of the frame such as an edge thereof.

With the arrangement described, the equipment frame is securely held by the support assembly and cannot move within it whereby vibration damage to the electronic components and their connections is substantially eliminated. Since the support assemblies are themselves a cost item, they are re-used whenever possible and the adjustability of the clamping members gives them greater flexibility in such use. It has been found also that because the wood clamping members are in close engagement with the equipment frame the tendency for the members to warp is reduced.

DESCRIPTION OF THE PREFERRED EMBODIMENT

Figure 1:
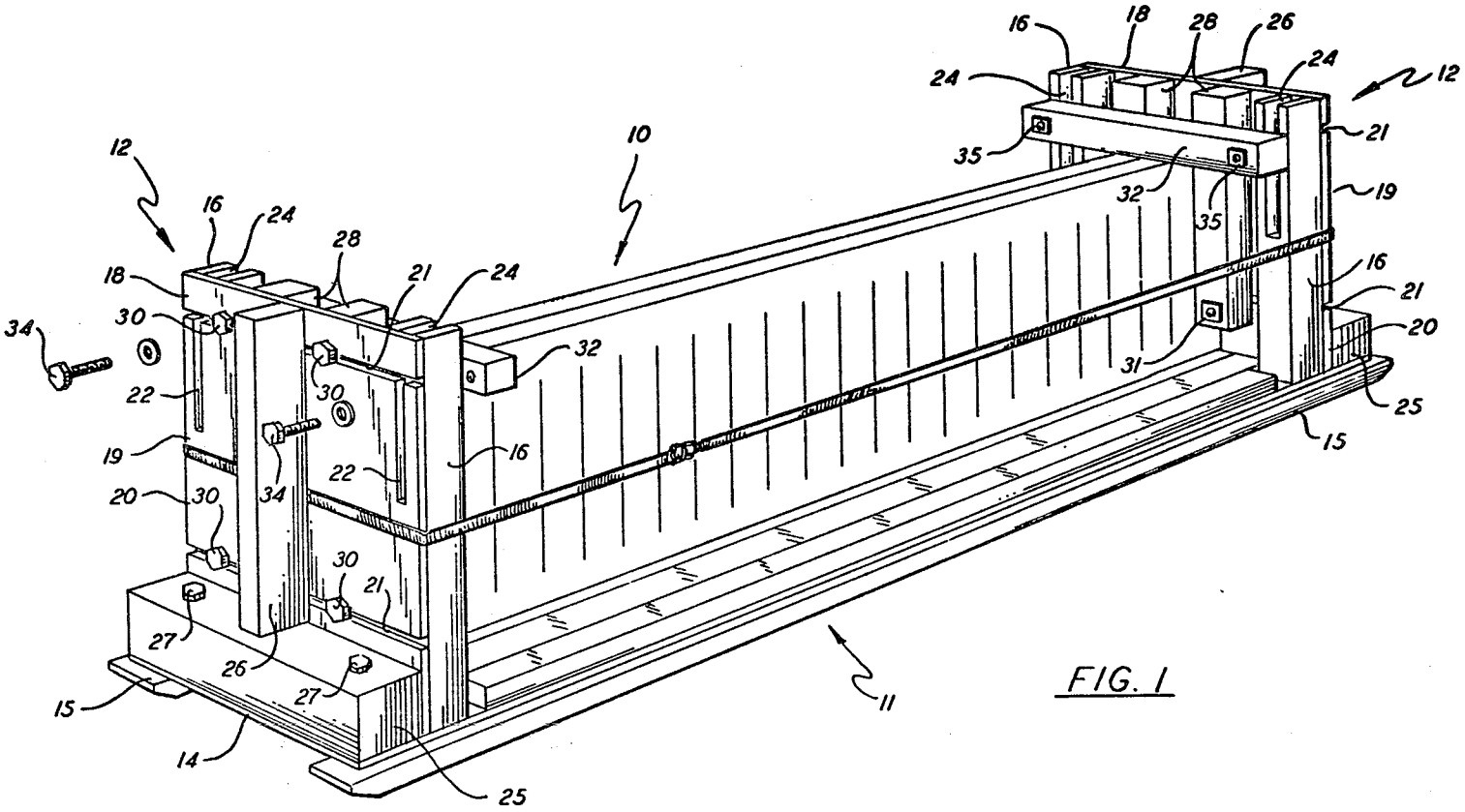
FIG. 1 is a perspective view of a support assembly embodying the invention with an electronic unit positioned therein.

Having reference now to the drawings, the support assembly is shown in FIG. 1 with an electronic unit 10 secured therein, the unit comprising an elongated frame or panel containing delicate electronic equipment such as communication equipment. The electronic equipment is not shown in any detail as it does not per se play any part in the invention. The support assembly is essentially comprised of a base assembly generally indicated at 11 and a pair of identical upstanding end braces generally indicated at 12. The end braces are rigidly secured to the ends of the base assembly in a manner to be described.

The base assembly includes a plywood deck 14 and two or more spaced runners 15 secured to the underside of the deck, the runners having bevelled ends as shown. Each end brace 12 includes a pair of slotted side members 16, which are 2 inches × 2½ inches wood pieces in the embodiment shown, and these are connected together by three plywood panels 18, 19 and 20. The upper and lower panels 18, 20 are spaced from the center panel 19 to form a pair of parallel, horizontal slots 21 in the end brace for a purpose to be described. The center planel 19 is formed with a pair of vertical slots 22 that register with vertical slots 24 in the side members 16, the slots 24 extending approximately half way down the members from the upper ends thereof.

Each end brace 12 has a horizontal block 25 of wood secured as by bolts (not shown) to its lower panel 20, and another wood piece 26 extends from the top of block 25 to the top of upper panel 18 as shown. The piece 26 is centered with respect to the side edges of the end brace and is rigidly secured to each of the three panels. In the embodiment of the invention disclosed, block 25 is preferably 4 × 4 inches and wood piece 26 is 2 × 4 inches. The end braces are secured to the base assembly 11 as by bolts 27 passing through the blocks 25.

Figure 2:
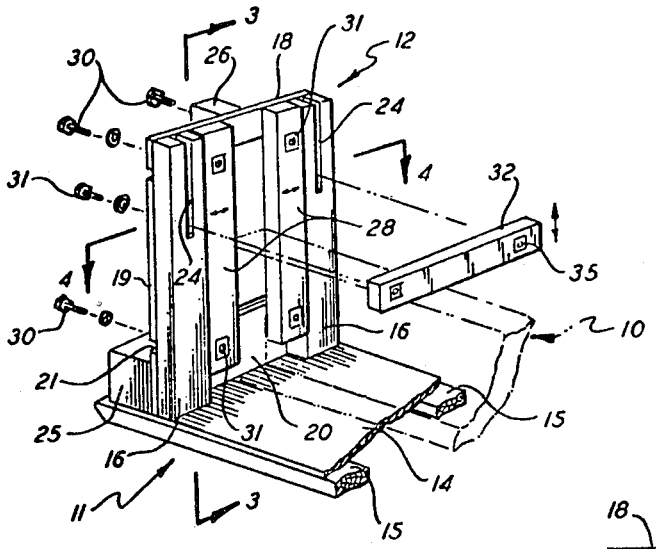
FIG. 2 is a perspective view of one end of the support assembly looking toward the inside of the end brace.
Figure 3:
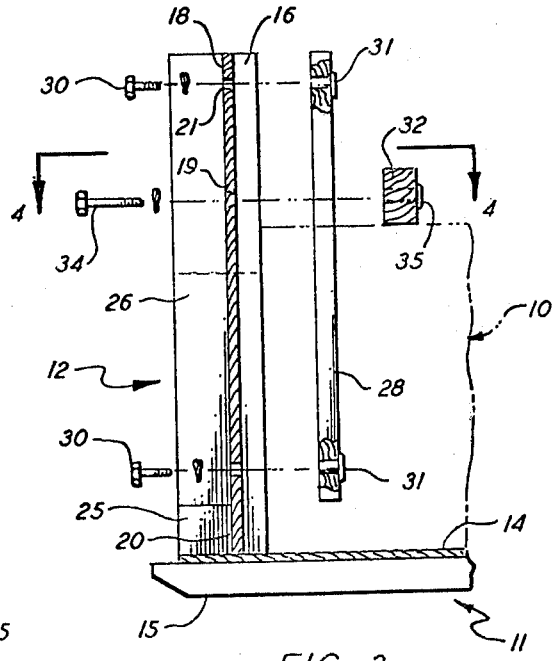
FIG. 3 is a partially exploded vertical section taken on line 3—3 of FIG. 2.
Figure 4:
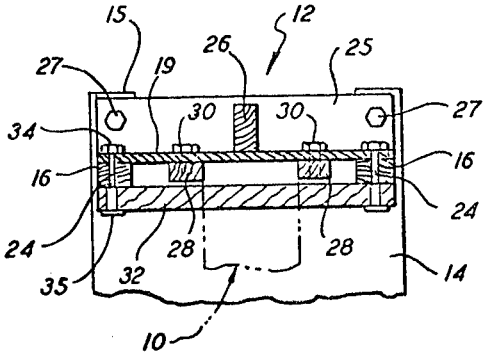
FIG. 4 is a horizontal section taken on line 4—4 of FIG. 2.

In accord with the invention, each end brace 12 is provided with a pair of parallel, vertical clamping members 28 which members are positioned inside the side members 16 in abutting relation to the panels 18, 19 and 20 as best shown in FIGS. 2 and 4. Members 28 are held in position by bolts 30, there being an upper and a lower bolt for each member which respectively pass through the upper and lower horizontal slots 21 and are threaded into T-nuts 31 in the members as indicated. With this arrangement, the clamping members can be moved towards or away from one another and are guided during such movement by the movement of the bolts in the slots. This enables the members 28 to be moved into positive gripping or clamping engagement with the ends of the electronic unit 10 as shown in FIG. 1.

In addition to the clamping members 28, each end brace 12 is provided with a horizontally disposed clamping member 32 that is mounted on the brace for movement towards or away from the base assembly 11. Member 32 abuts against the slotted side members 16 as shown in FIGS. 1 and 4, and is held in position by a pair of bolts 34 which respectively pass through the registering vertical slots 22, 24 adjacent the side edges of the end brace. The bolts are threaded into T-nuts 35 in the member. The horizontal clamping member is thus guided in its up or down movement by the movement of bolts 34 in the vertical slots. This enables the members 32 to be moved into clamping engagement with the upper edge of the electronic unit 10 as shown in FIG. 1 whereby the unit is clamped between the base assembly 11 and the members.

In preparing a unit of electronic equipment for shipment, the unit 10 is placed on the base assembly 11 in edgewise position as shown in FIG. 1, the unit being centered between the longitudinal side edges of the deck 14. The end braces 12 are then placed on the base assembly so that the panels 18, 19 and 20 abut against the ends of the unit after which the braces are secured to the base by the bolts 27. The bolts 30 for the clamping members 28 are then loosened and the members, which initially are in their widest apart position, are moved into tight engagement with the ends of the unit 10 and bolts 30 are tightened to secure the clamping members in this position.

After the members 28 have been secured in clamping position, the horizontal clamping members 32 are moved down into tight engagement with the unit 10 after which their bolts 34 are tightened to secure the members in position. When the electrical unit has been secured in the support assembly as described, it is clamped in a three-dimensional manner being restricted from lengthwise movement by the end brace panels 18, 19 and 20, from transverse movement by the clamping members 28 and from up and down movement by the clamping members 32. The packing for the unit 10 is completed by a dirt and dust excluding corrugated enclosure, nylon straps, etc. which do not form a part of the present invention.

From the foregoing description, it will be apparent that the invention provides a novel and very advantageous support assembly for protecting delicate electrical equipment against damage during shipping. As will be understood by those familiar with the art, the invention may be embodied in other specific forms without departing from the spirit or essential characteristics thereof.

I claim:

1. A packaging assembly for supporting delicate electronic equipment within an outer carton during shipping, the support assembly comprising a normally horizontal base assembly and a pair of upstanding end braces respectively secured to the base assembly at opposite ends thereof, each end brace having a pair of normally vertical clamping members movable towards or away from one another for engaging and clamping therebetween terminal portions of the equipment being shipped, each end brace also having a normally horizontally disposed member movable towards or away from the base assembly for engaging the equipment being shipped and clamping it between the horizontally disposed member and base assembly.

2. A packaging assembly as defined in claim 1 wherein the normally vertical clamping members are parallel to one another, each end brace having an upper and a lower normally horizontally disposed slot and bolts extending through the slots and into the clamping members to guide the members during their movement into clamping engagement with the equipment, the bolts also enabling the members to be securely held in clamping position.

3. A packaging assembly as defined in claim 1 wherein each end brace has a pair of spaced apart normally vertical slots and a bolt extending through each slot into the normally horizontally disposed member to guide the latter during its movement into clamping engagement with the equipment.

4. A packaging assembly as defined in claim 1 wherein the normally horizontally disposed member overlies the normally vertical clamping members.

5. An assembly for protectively supporting during shipping a frame having delicate electronic equipment mounted therein, the support assembly comprising a normally horizontal base assembly and a pair of upstanding end braces respectively secured to the base assembly at opposite ends thereof, each end brace having a pair of normally vertical, parallel clamping members movable towards or away from one another for engaging and clamping therebetween an end of the equipment frame, each end brace being formed with a pair of spaced apart normally horizontal slots and including bolts that extend through the slots and into the clamping members to guide the latter during their movement into clamping engagement with the frame, each end brace also including a normally horizontally disposed member movable towards or away from the base assembly for engaging the frame and clamping it between the horizontally disposed member and base assembly, each end brace being formed with a pair of spaced apart normally vertical slots and including a bolt that extends through each slot into the horizontally disposed member to guide the latter during its movement into clamping engagement with the frame.

6. A support assembly as defined in claim 5 wherein the normally horizontally disposed member overlies the normally vertical clamping members.

7. A support assembly as defined in claim 5 wherein the base assembly includes a flat deck member and a plurality of spaced apart runners secured to the underside of the deck member.

* * * * *